US007020849B1

(12) United States Patent
Chen

(10) Patent No.: US 7,020,849 B1
(45) Date of Patent: Mar. 28, 2006

(54) DYNAMIC DISPLAY FOR COMMUNICATION DEVICES

(75) Inventor: David Chen, San Carlos, CA (US)

(73) Assignee: Openwave Systems Inc., Redwood City, CA (US)

( * ) Notice: Subject to any disclaimer, the term of this patent is extended or adjusted under 35 U.S.C. 154(b) by 597 days.

(21) Appl. No.: 10/159,955

(22) Filed: May 31, 2002

(51) Int. Cl.
*G09G 5/00* (2006.01)

(52) U.S. Cl. ..... 715/864; 715/817; 715/825; 345/1.1; 345/1.2

(58) Field of Classification Search ..... 715/864, 715/817, 825, 866, 767; 345/1.1, 1.2, 3.1, 345/3.4, 205; 455/566
See application file for complete search history.

(56) References Cited

U.S. PATENT DOCUMENTS

| | | | | |
|---|---|---|---|---|
| 5,737,394 | A * | 4/1998 | Anderson et al. | 379/88.11 |
| 6,115,041 | A * | 9/2000 | Dang et al. | 715/767 |
| 6,366,302 | B1 * | 4/2002 | Crosby et al. | 715/786 |
| 6,408,191 | B1 * | 6/2002 | Blanchard et al. | 455/566 |
| 6,415,164 | B1 * | 7/2002 | Blanchard et al. | 455/566 |
| 6,819,341 | B1 * | 11/2004 | Dow et al. | 715/772 |
| 2004/0205156 | A1 * | 10/2004 | Aarts et al. | 709/218 |

* cited by examiner

*Primary Examiner*—Tadesse Hailu
(74) *Attorney, Agent, or Firm*—Beyer Weaver & Thomas, LLP

(57) ABSTRACT

Techniques for displaying information on communication devices are disclosed. The techniques are highly beneficial for devices with relatively small viewing areas (e.g., remote wireless phones). An enhanced communication device can be implemented which can dynamically display information on an associated display. This means that there is no need to reserve various areas on the display for displaying. Instead, information may be assigned or unassigned to the different display portions dynamically. As a result, the display area can be used more efficiently.

17 Claims, 6 Drawing Sheets

DYNAMIC DISPLAY FOR COMMUNICATION DEVICES

BACKGROUND OF THE INVENTION

1. Field of the Invention

The present invention relates to communication systems, and more particularly, to displaying information on communication devices.

2. Description of the Related Art

Modern communication systems facilitate communication of information in many forms and between various communication devices (e.g., computers, wireless terminals or devices, cellular telephones, pagers, personal digital assistants, etc.). Given the popularity of modern communication systems, extensive efforts have been made by a number of entities to provide users with the ability to access information on demand. As such, users can use a variety of handheld communication devices to access information. Users may, for example, access information which is available on the Internet or on a remote private database. Typically, handheld communication devices have a relatively small amount of display space available in comparison to desktop devices (e.g., a personal desktop computer). Accordingly, for handheld communication devices, it is highly desirable to use the relatively small amount of display space in an efficient manner.

Unfortunately, conventional techniques fail to use the display space in an efficient manner. To illustrate, FIG. 1A depicts a conventional communication device 10 with an associated display 12. The conventional communication device 10 includes a numerical pad 14 and soft keys 16 and 18. Referring now to FIG. 1B, the display unit 12 in FIG. 1A is shown in greater detail. The display unit 12 is partitioned into portions 20, 22 and 24. In operation, the display unit 12 can be used to display content information (e.g., text relating to a document) as well as labels (e.g., functional labels or contextual labels). The content information is displayed in the display portion 24 and labels are displayed in display portions 20 and 22.

As shown in FIG. 1B, a contextual label, namely, a title, is displayed in the display portion 20. The title displayed in the display portion 20 provides contextual information for the text displayed in the display portion 24. In other words, the title displayed in display portion 20 is the title for the document (or portion of the document) that is displayed at the display portion 24. While functional labels 30 and 32 displayed at display portion 22 respectively correspond to labels for soft keys SF1 16 and SF2 18, these functional labels can, for example, be used to identify various functions (e.g., OK, Cancel) which are respectively provided by the soft keys SF1 16 and SF2 18 at any given time.

One serious drawback with the conventional display 12 is that display portions 20, 22 are reserved to display only labels. In other words, conventional displaying techniques typically don't allow content to be displayed in display portions 20 and 22. In fact, contextual and/or functional labels can be constantly displayed in display portion 20 and 22 regardless of the situation. In any case, only a limited area of the display 12 (i.e., display portion 24) can be used to display content information since the display portions 20 and 22 are always reserved to display labels. In devices with relatively small viewing areas, this deficiency is a serious drawback.

Accordingly, there is a need for improved displaying techniques.

SUMMARY OF THE INVENTION

Broadly speaking, the invention relates to techniques for displaying information on communication devices. The techniques are highly beneficial for devices with relatively small viewing areas (e.g., remote wireless phones). In accordance with one aspect of the invention, an enhanced communication device suitable for operation in a communication system is disclosed. In operation, the enhanced communication device can dynamically display information on an associated display. This means that there is no need to reserve various areas on the display for displaying. Instead, information may be assigned or unassigned to the different display portions dynamically. As a result, the display area can be used more efficiently.

The invention can be implemented in numerous ways, including as a method, an apparatus, and computer readable media. Several embodiments of the invention are discussed below.

As a method for displaying information on a display associated with a device, one embodiment of the invention include the acts of: determining whether at least one label should be displayed on the display unit; assigning at least one region on the display unit when it is determined that at least one label should be displayed on the display unit; and displaying at least one label in at least one assigned region.

As a method for displaying information on a display associated with a device, another embodiment of the invention includes the acts of: determining whether at least one label should be displayed on the display unit; assigning at least one region on the display unit when it is determined that at least one label should be displayed on the display unit; displaying at least one label in at least one assigned region; not displaying any labels in at least one unassigned region; and displaying information other than labels in at least one unassigned region.

As a method for displaying information on a display unit having a first and a second region which can be used to display label information, one embodiment of the invention includes the acts of: displaying a title in the first region of the display unit and displaying content information in the second region; displaying the title in the first region of the display unit and displaying at least one soft key label in the second region of the display unit; determining whether label information should not be displayed; and displaying content information in both the first and second regions when it is determined that no label information should be displayed.

The advantages of the invention are numerous. Different embodiments or implementations may have one or more of the following advantages. One advantage is that more efficient displaying techniques can be utilized. Another advantage is that the invention can be implemented to enhance the reading experience for users of communication devices. Yet another advantage is that the invention provides the flexibility of presenting information in accordance with different desires or needs of the users. Still another advantage is that it is possible to implement the invention without significantly departing from user expectations and established conventions.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

As noted in the background, conventional displaying techniques typically reserve a portion of the display space to display information other than content (e.g., contextual or functional labels). This means that only a limited portion of the display is conventionally used to display content (e.g., text) or possibly other information which may be more desirable to display (e.g., functional menus). This is a serious drawback, especially for devices with relatively small viewing area. Thus, there is a need for improved displaying techniques.

Accordingly, the invention pertains to techniques for displaying information on communication devices. These techniques are highly beneficial for devices with relatively small viewing areas (e.g., remote wireless phones). In accordance with one aspect of the invention, an enhanced communication device suitable for operating in a communication system is disclosed. In operation, the enhanced communication device can dynamically display information on an associated display. This means that there is no need to reserve various areas on the display for displaying. Instead, information may be assigned or unassigned to the different display portions dynamically. As a result, the display area can be used more efficiently.

Embodiments of the invention are discussed below with reference to FIGS. 1–4B. However, those skilled in the art will readily appreciate that the detailed description given herein with respect to these figures is for explanatory purposes as the invention extends beyond these limited embodiments.

Figure 1A:
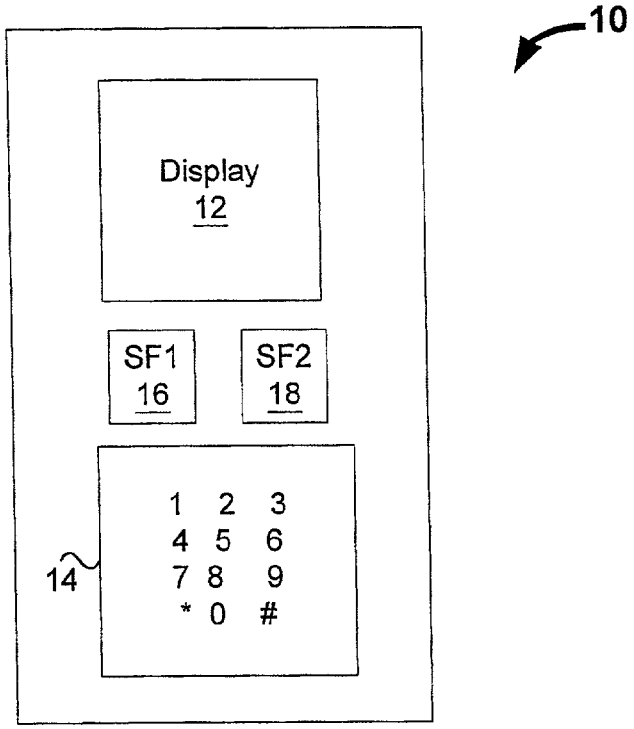
(Prior Art) Fig. 1A
FIGS. 1A and 1B depict a conventional communication device with an associated display.
Figure 1B:
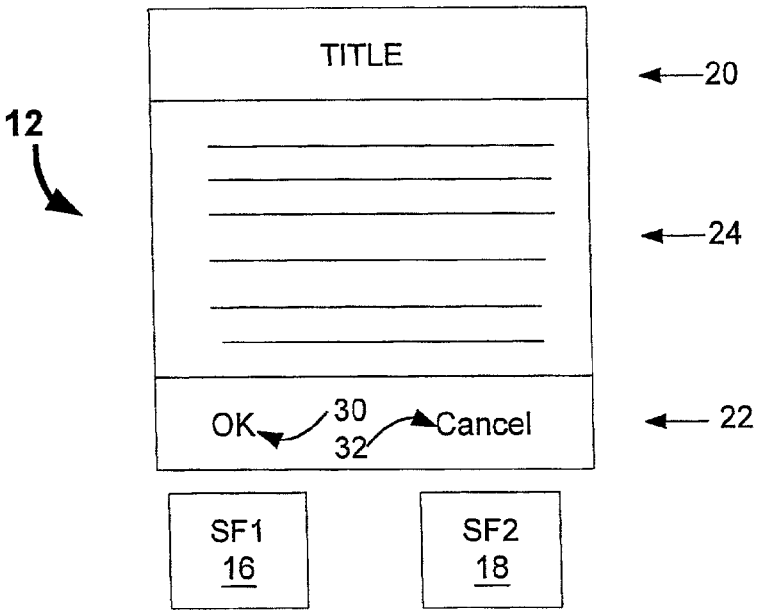
(Prior Art) Fig. 1B
Figure 1C:
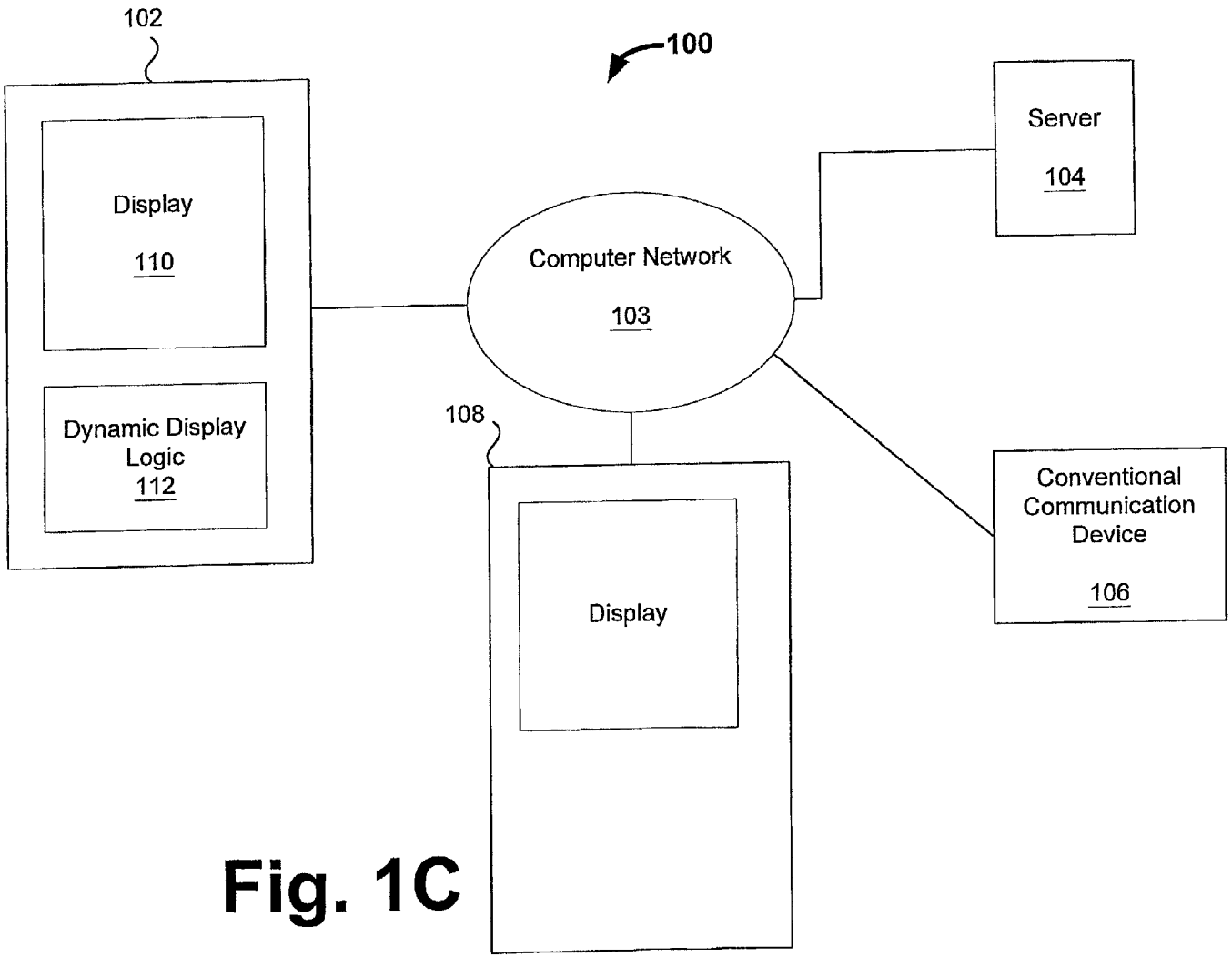
FIG. 1C illustrates a communication system including an enhanced communication device in accordance with one embodiment of the invention.

FIG. 1C illustrates a communication system 100 including an enhanced communication device 102 in accordance with one embodiment of the invention. The enhanced communication device 102 can, for example, be implemented as a computer, a remote wireless device, a cell phone, a Personal Digital Assistant, etc. The enhanced communication device 102 can communicate with a communication network 103. The communication network 103 may be or include, for example, the Internet, one or more campus intranets, local area networks (LANs), wide area networks (WANs), or wireless telecommunication networks, e.g., a cellular digital packet data (CDPD) network, a global system for mobile (GSM) communications network, a time division multiple access (TDMA) network, a personal digital cellular (PDC) network, or a personal handy-phone system (PHS) network. In any case, the communication network 103 facilitates communication between the enhanced communication device 102 and various other components of the communication system 100. These components can, for example, include a server 104, a conventional communication device 106 or another enhanced communication device 108.

For illustration purposes, in FIG. 1C, the enhanced communication device 102 is shown to include a display 110 and a dynamic display logic 112. However, as will be appreciated by those skilled in the art, the operations related to dynamic display logic can entirely or at least partially be performed at a server or a gateway. Alternatively, the dynamic display logic 112 can be implemented as a part of the hardware and/or software in the enhanced communication device 102. In any case, the dynamic display logic 112 facilitates dynamic display of information on the display 110.

The dynamic display logic 112 can operate to determine when various types of information are to be displayed. This means, for example, non-content information (e.g., labels) can be displayed dynamically so that there is no need to reserve space on the display. In other words, the dynamic display logic 112 can operate to determine when and where content and/or non-content information is to be displayed. Thus, labels need not be displayed in all cases. Instead, more content or other more suitable information (e.g., menu options) can be displayed. As a result, the display area of the display 112 is used more efficiently (e.g., relatively more space can be used to display content information, in some cases).

Figure 2:
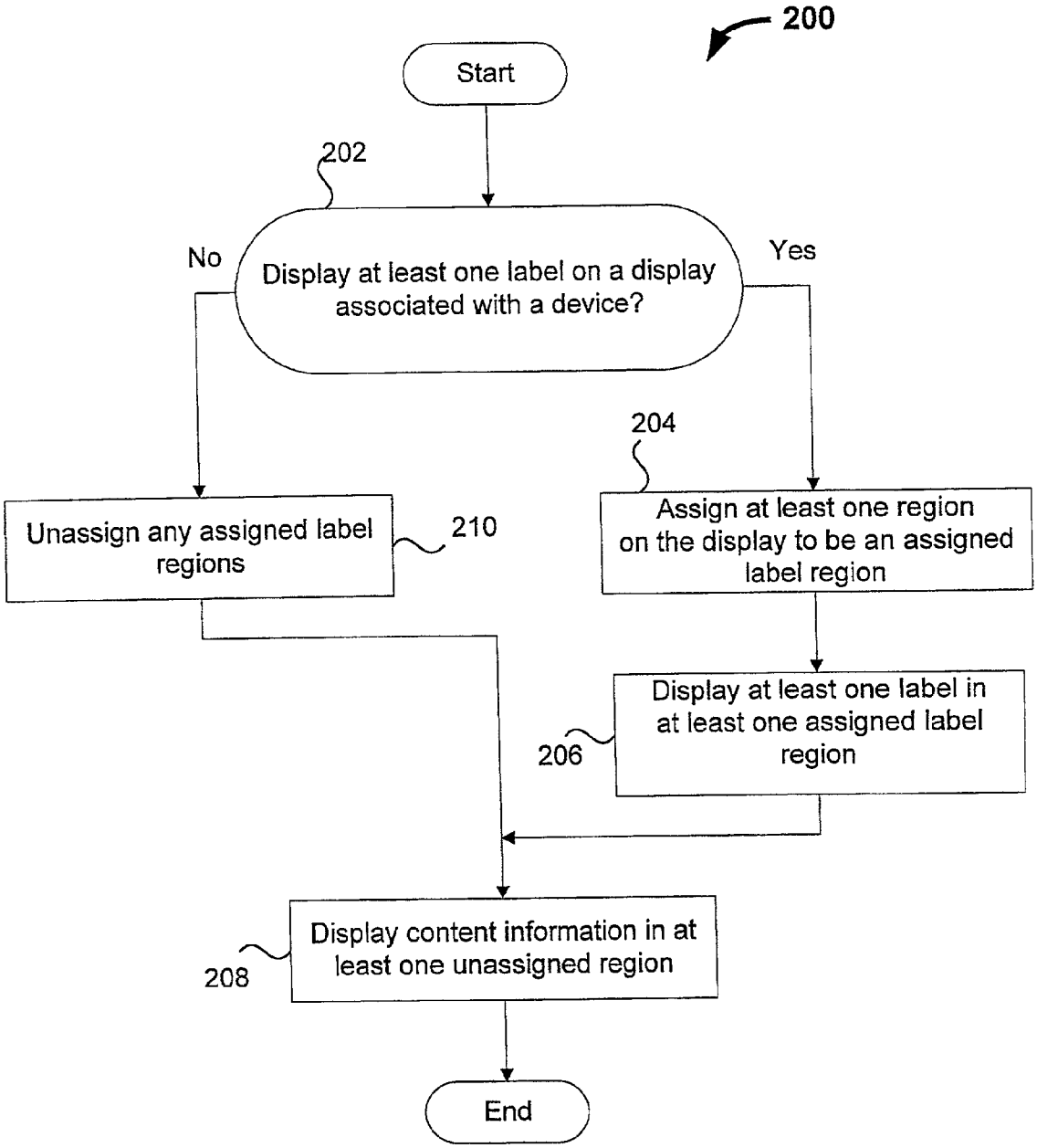
FIG. 2 illustrates a displaying method for displaying information on a display associated with a device in accordance with one embodiment of the invention.

FIG. 2 illustrates a displaying method 200 for displaying information on a display associated with a device in accordance with one embodiment of the invention. The displaying method 200 can, for example, be used by the dynamic display logic 112 of the enhanced communication device 102 shown in FIG. 1. Initially, at operation 202, a determination is made as to whether at least one label should be displayed on the display associated with a device. If it is determined at operation 202 that at least one label should be displayed on the display, the display method 200 proceeds to operation 204 where at least one region on the display is assigned to be an assigned region. Next, at operation 206, at least one label in at least one assigned region is displayed. Thereafter, at operation 208, content information is displayed in at least one unassigned region. The display method 200 ends following operation 208. However, if it is determined at operation 202 that no labels should be displayed on the display, the display method 200 proceeds to operation 210 where any assigned region is unassigned. Next, at operation 208, content information is displayed in at least one unassigned region. The display method 200 ends following operation 208.

Figure 3:
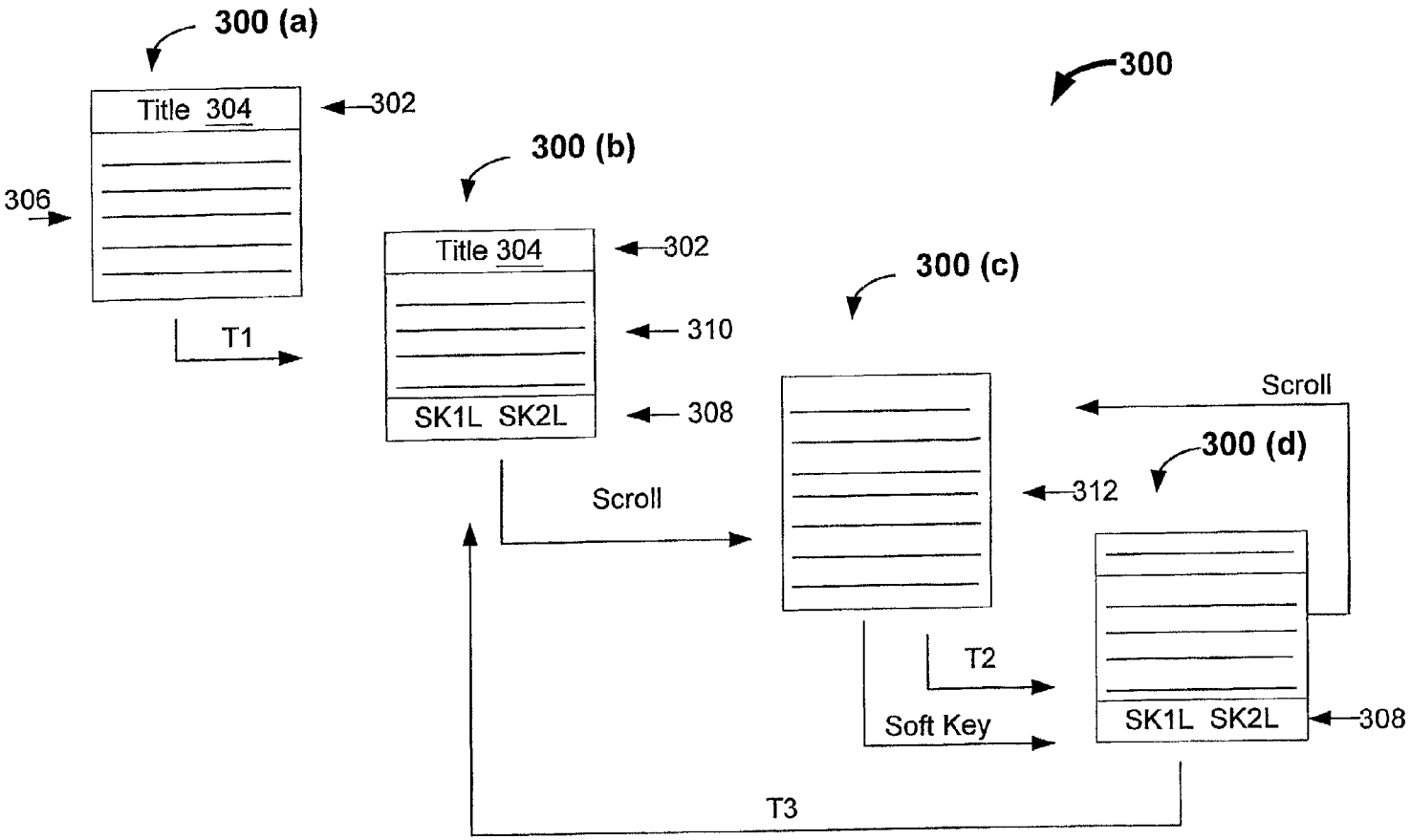
FIG. 3 illustrates an exemplary display sequence suitable for display on a communication device in accordance with one embodiment of the invention.

FIG. 3 illustrates an exemplary display sequence 300 suitable for display on a communication device in accordance with one embodiment of the invention. The display sequence 300 can, for example, be displayed by the enhanced communication device 102 of FIG. 1. Initially, at screen 300(*a*), label information is displayed in a portion 302 as a title 304. The title 304 can be referred to as "a contextual label" which provides contextual information (i.e., a title) for the content information (i.e., text) which is displayed in the portion 306 of the screen 300(*a*). After a first delay T1, a screen 300(*b*) is displayed. As shown in screen 300(*b*), in addition to the title 304, functional labels SK1L and SK2L are displayed in display portion 308. The functional labels SK1L and SK2L respectively represent labels which are displayed for the soft key buttons associated with a communication device. It should be noted that the functional labels SK1L and SK2L were not displayed in the screen 300(*a*). This allows for relatively more content information to be displayed in the screen portion 306 of screen 300(*a*) in comparison with the screen portion 310 of screen 300(*b*).

When the screen 300(*b*) is displayed and the user initiates a scroll-down, screen 300(*c*) is displayed. It should be noted that no title or functional labels are displayed in screen 300(*c*). As a result, relatively more content information can be displayed in display portion 312 in comparison with both display portions 306 and 310 respectively shown in screens 300(*a*) and 300(*b*). After a delay T2, screen 300(*d*) is displayed. In the screen 300(*d*), the functional labels SK1L and SK2L are displayed in the display portion 308. However, it should be noted that no title is displayed in the screen 300(*d*). In addition, it should also be noted that the functional labels SK1L and SK2L can be displayed before the delay T2 if a soft key is activated.

In any case, after a delay T3, the display sequence 300 proceeds from screen 300(*d*) to the screen 300(*b*). As noted above, in the screen 300(*b*), both the title 304 and functional labels SK1L and SK2L are displayed. However, if a scroll-down is performed before the delay T3 has been performed, the display sequence 300 proceeds from screen 300(*d*) to 300(*c*).

Figure 4A:
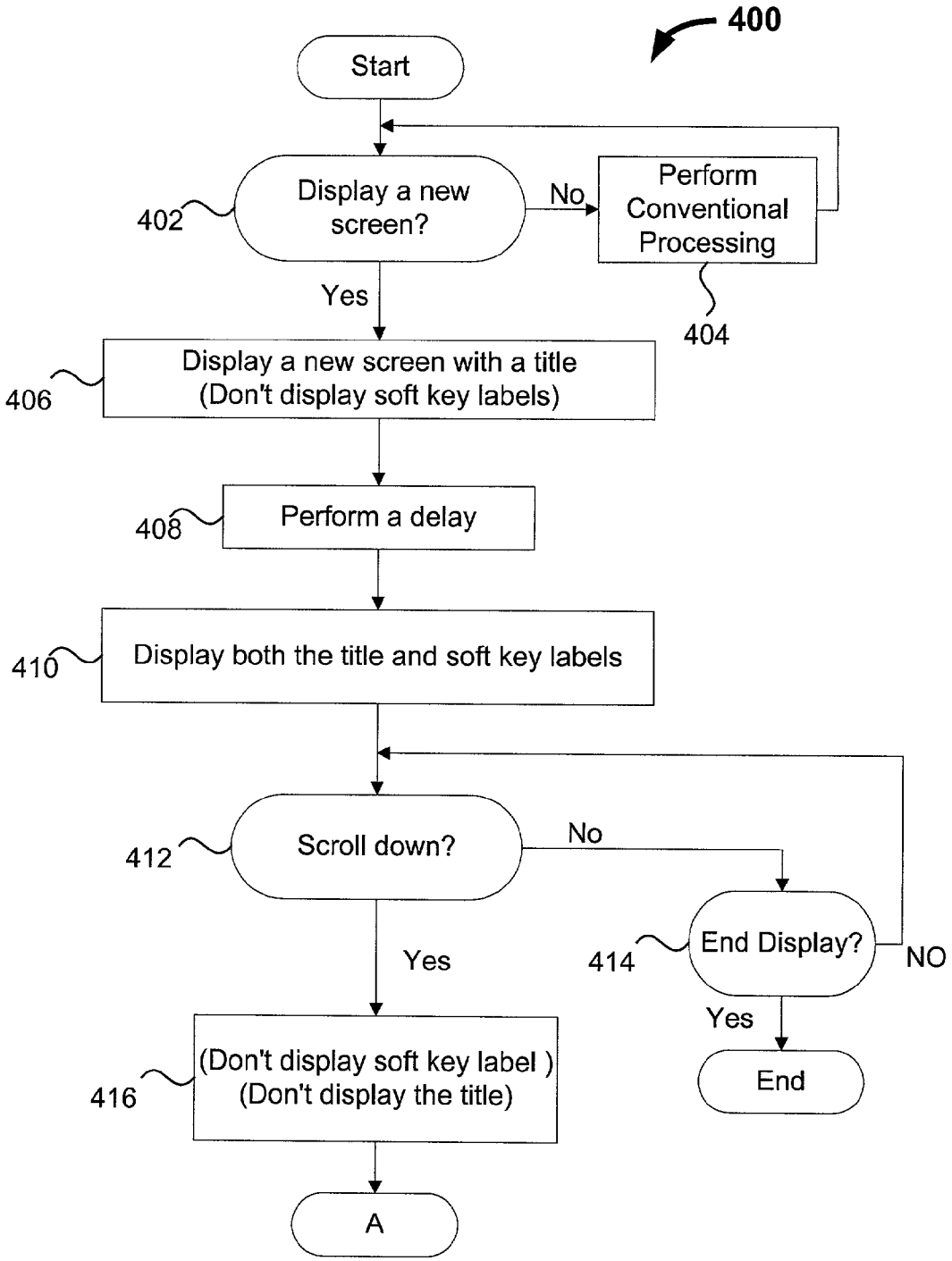
FIGS. 4A and 4B illustrate a display method in accordance with one embodiment of the invention.
Figure 4B:
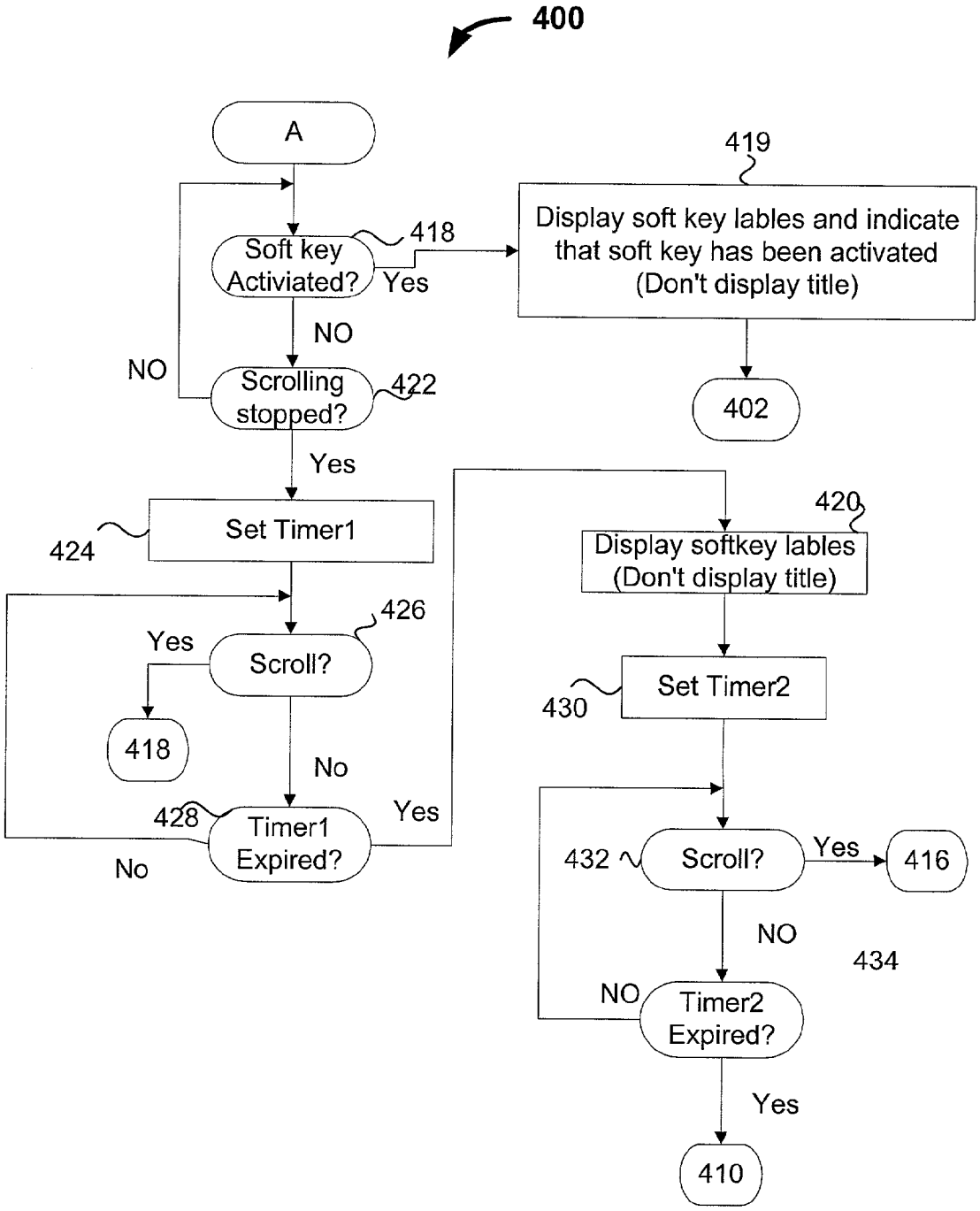

FIGS. 4A and 4B illustrate a display method 400 in accordance with one embodiment of the invention. The display method 400 can, for example, be implemented by the dynamic display logic 112. Initially, at operation 402 a determination is made as to whether a new screen should be displayed. If it is determined at operation 402 that a new screen should not be displayed, the display method 400 proceeds to operation 404 where conventional processing is performed. Thereafter, the display method 400 proceeds to operation 402 where a determination is made as to whether a new screen should be displayed.

However, if it is determined at operation 402 that a new screen should be displayed, the display method 400 proceeds to operation 406 where a new screen with a title is displayed. It should be noted that no soft key labels are displayed. Next, at operation 408, a delay is performed. The delay can, for example, be for a predetermined amount of time (e.g., 5 seconds). Alternatively, the length of delay can be determined dynamically based on one or more variables.

In any case, after the delay is performed at operation 408, the display method 400 proceeds to operation 410 where both the title and soft key labels are displayed. Next, at operation 412, a determination is made as to whether a scroll down has been performed. If it is determined at operation 412 that no scroll down has been performed, the display method 400 proceeds to operation 414 where it is determined whether the display of the screen should be terminated. If it is determined at operation 414 that the display of the screen should be terminated, the display method 400 ends. However, if it is determined at operation 414 that the display of the screen should not be terminated, the display method 400 proceeds to operation 412 where it is determined whether a scroll-down has been performed.

If it is determined at operation 412 that a scroll-down has been performed, the display method 400 proceeds to operation 416 where neither the title nor the functional labels are displayed. Referring now to FIG. 4B, at operation 418 a determination is made as to whether a soft key has been activated. If it is determined at operation 418 that a soft key has been activated, the display method 400 proceeds to operation 419 where the soft key labels are displayed and it is indicated that the soft key has been activated, but no title is displayed.

On the other hand, if it is determined at operation 418 that a soft key has not been activated, the display method 400 proceeds to operation 422 where a determination is made as to whether the scrolling action has been terminated. If it is determined at operation 422 that the scrolling has not been terminated, the display method 400 proceeds to operation 418 where a determination is made as to whether a soft key has been activated. Thereafter, the display method 400 proceeds in a similar manner as described above. However, if it is determined at operation 422 that scrolling has stopped, the display method 400 proceeds to operation 424 where a first timer (Timer1) is set. It should be noted that Timer1 can, for example, be set for a predetermined amount of time (e.g., 5 seconds). Alternatively, Timer1 can be set dynamically based on one or more variables. For example, Timer 1 can be set for relatively shorter time delays when the top or bottom of the page is reached. In this way, soft key label regions would be displayed relatively faster in some situations.

Next, at operation 426, a determination is made as to whether scrolling has been initiated. If it is determined at operation 426 that scrolling has been initiated, the display method 400 proceeds to operation 418 where a determination is made as to whether a soft key has been activated. Thereafter, the display method 400 proceeds in a similar manner as described above.

However, if it is determined at operation 426 that scrolling has not been initiated, the display method 400 proceeds to operation 428 where it is determined whether Timer1 has expired. If it is determined at operation 428 that Timer1 has not expired, the display method 400 proceeds to operation 426 where a determination is made as to whether scrolling has been initiated. However, if it is determined at operation 428 that Timer1 has expired, the display method 400 proceeds to operation 420 where the soft key labels are displayed but no title is displayed. Next, at operation 430 a second timer (Timer2) is set. Similar to Timer1, Timer2 can be set for a predetermined amount of time (e.g., 10 seconds) or can be set dynamically based on one or more variables.

In any case, after Timer2 is set at operation 430, the display method 400 proceeds to operation 432 where a determination is made as to whether a scrolling action has been initiated. If it is determined at operation 432 that a scrolling action has been initiated, the display method 400 proceeds to operation 416 where neither the title nor the functional labels are displayed. However, if it is determined at operation 432 that a scrolling action has not been initiated, the display method 400 proceeds to operation 434 where a determination is made as to whether Timer2 has expired.

If it is determined at operation 434 that Timer2 has not expired, the display method 400 proceeds to operation 434 where it is determined whether a scroll action has been initiated. However, if it is determined at operation 434 that Timer2 has not expired, the display method 400 proceeds to operation 432 where it is determined whether a scrolling action has been initiated. On the other hand, if it is determined at operation 434 that Timer2 has expired, the display method 400 proceeds to operation 410 where both the title and soft key labels are displayed. Thereafter, the display method 400 proceeds in a similar manner as discussed above. The display method 400 ends when it is determined at operation 414 that the display should end.

It should be noted that the invention can be implemented to further enhance the viewing experience. In one embodiment, the title, label, and underlying content are displayed in a manner which makes them easier to be visually distinguished by a human (e.g., various colors or shades are used). In addition, animation can be used to further enhance the viewing experience. Animation can be used to simulate motion which typically is easier for the user to detect. For example, labels can be shown using a "sliding" motion which simulates gradually drawing a label on the display. Similarly, a "fading" motion can be used to simulate gradually erasing labels. Furthermore, scroll indicators can also be dynamically displayed. This can be achieved, for example, by using another timer or using one or more of the timers used to display labels (e.g., timer1 or timer2 of FIG. 4B).

The advantages of the invention are numerous. Different embodiments or implementations may have one or more of the following advantages. One advantage is that more efficient displaying techniques can be utilized. Another advantage is that the invention can be implemented to enhance the reading experience for users of communication devices. Yet another advantage is that the invention provides the flexibility of presenting information in accordance with different desires or needs of the users. Still another advantage is that it is possible to implement the invention without significantly departing from user expectations and established conventions.

The many features and advantages of the present invention are apparent from the written description, and thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A method for displaying information on a display associated with a device, said display unit having a first and a second region which can be used to display label information, said method comprising:

displaying a title in said first region of said display unit and displaying content information in said second region;

displaying said title in said first region of said display unit and displaying at least one soft key label in said second region of said display unit;

determining whether label information should not be displayed; and displaying content information in both said first and second regions when said determining determines that no label information should be displayed.

2. A method as recited in 1, wherein said method further comprises:

initiating a first timer; and displaying at least one soft key label in said second region of said display unit when said first timer has expired.

3. A method as recited in 2, wherein said method further comprises:

displaying at least one soft key label in said second region of said display unit before said first timer has expired when at least one soft key has been activated.

4. A method as recited in 3, wherein said method further comprises:

initiating a second timer; and displaying said title in said first region and displaying at least one soft key label in said second region of said display unit when said second timer has expired.

5. A communication device comprising;

a display including a first and a second region;

wherein said communication device is capable of operating to:

display a title in said first region of said display unit and display content information in said second region;

display said title in said first region of said display unit and display at least one soft key label in said second region of said display unit;

determine whether label information should not be displayed;

display content information in both said first and second regions when it is determined that no label information should be displayed.

6. A communication device as recited in claim 5, wherein said device is further capable of operating to:

initiate a first timer; and display at least one soft key label in said second region of said display unit when said first timer has expired.

7. A communication device as recited in claim 6, wherein said device is further capable of operating to:

display at least one soft key label in said second region of said display unit before said first timer has expired when at least one soft key has been activated.

8. A communication device as recited in claim 6, wherein said device is further capable of operating to:

initiate a second timer; and display said title in said first region and displaying at least one soft key label in said second region of said display unit when said second timer has expired.

9. A method for dynamically displaying data on a display associated with a device, said method comprising:

determining whether to display a first data on said display;

displaying a second data on said display when said determining determines not to display said first data;

logically dividing said display into first and second display-portions when said determining determines to display said first data;

displaying said first data on said first display-portion of said display after said logically dividing of said display; and displaying said second data on said second display-portion of said display after said logically dividing of said display.

10. A method as recited in claim 9, wherein said displaying of said second data displays only said second data on said display.

11. A method as recited in claim 10, wherein said second data is displayed on the entire displayable space of said display.

12. A method as recited in claim 11, wherein said scroll movement is associated with scrolling content information displayed on said display.

13. A method as recited in claim 9, wherein said first data is associated with control or context information and said second data is associated with content information.

14. A method as recited in claim 9, wherein said determining of whether to display a first data on said display comprises one or more of the following:

detecting whether a scrolling movement has been initiated;

detecting whether a scrolling movement has been stopped; and determining whether a timer has expired.

15. A method as recited in claim 9, wherein said data is the only data displayed on said display.

16. A computer readable medium including computer program code for dynamically displaying data on a display associated with a device, said computer readable medium comprising:

computer program code for determining whether to display a first data on said display;

computer program code for displaying a second data on said display when said determining determines not to display said first data;

computer program code for logically dividing said display into first and second display-portions when said determining determines to display said first data;

computer program code for displaying said first data on said first display-portion of said display after said logically dividing of said display; and computer program code for displaying said second data on said second display-portion of said display after said logically dividing of said display.

17. A device capable of dynamically displaying data on associated display, wherein said device is capable of operating to:

determine whether to display a first data on said display;

display a second data on said display when said determining determines not to display said first data;

logically divide said display into first and second display-portions when said determining determines to display said first data;

display said first data on said first display-portion of said display after said logically dividing of said display; and display said second data on said second display-portion of said display after said logically dividing of said display.

* * * * *